US005789698A

United States Patent [19]

Beal

[11] Patent Number: 5,789,698

[45] Date of Patent: Aug. 4, 1998

[54] PROJECTILE FOR AMMUNITION CARTRIDGE

[75] Inventor: Harold F. Beal, Rockford, Tenn.

[73] Assignee: Cove Corporation, Knoxville, Tenn.

[21] Appl. No.: 792,578

[22] Filed: Jan. 30, 1997

[51] Int. Cl.[6] ..... F42B 12/34; F42B 12/74

[52] U.S. Cl. ..... 102/516; 102/506; 102/507; 102/517

[58] Field of Search ..... 102/501, 506–510, 102/514, 516–519

[56] References Cited

U.S. PATENT DOCUMENTS

| | | | |
|---|---|---|---|
| 33,754 | 11/1861 | Sawyer | 102/506 |
| 1,328,334 | 1/1920 | Newton | 102/508 |
| 3,888,636 | 6/1975 | Sczerzenie et al. | 29/182 |
| 3,898,933 | 8/1975 | Castera et al. | 103/529 |
| 4,165,692 | 8/1979 | Dufort | 102/92.7 |
| 4,428,295 | 1/1984 | Urs | 102/448 |
| 4,458,599 | 7/1984 | Mullendore et al. | 102/517 |
| 4,498,395 | 2/1985 | Kock et al. | 102/517 |
| 4,517,897 | 5/1985 | Kneubühl | 102/439 |
| 4,592,283 | 6/1986 | Hellner et al. | 102/493 |
| 4,716,835 | 1/1988 | Leemans | 102/529 |
| 4,895,077 | 1/1990 | Miethlich et al. | 102/517 |
| 4,897,117 | 1/1990 | Penrice | 75/248 |
| 4,935,200 | 6/1990 | LaSalle et al. | 420/3 |
| 4,940,404 | 7/1990 | Ammon et al. | 419/28 |
| 4,958,572 | 9/1990 | Martel | 102/529 |
| 4,970,960 | 11/1990 | Feldmann | 102/506 |
| 5,035,183 | 7/1991 | Luxton | 102/502 |
| 5,064,462 | 11/1991 | Mullendore et al. | 75/248 |
| 5,078,054 | 1/1992 | Ashok et al. | 102/517 |
| 5,189,252 | 2/1993 | Huffman et al. | 102/459 |
| 5,198,616 | 3/1993 | Anderson | 102/501 |
| 5,261,941 | 11/1993 | Sheinberg | 75/248 |
| 5,264,022 | 11/1993 | Haygarth et al. | 75/255 |
| 5,275,108 | 1/1994 | Chernicky et al. | 102/439 |
| 5,293,822 | 3/1994 | Peddie | 102/506 |
| 5,325,787 | 7/1994 | Baual | 102/506 |
| 5,399,187 | 3/1995 | Mravic et al. | 75/228 |
| 5,527,376 | 6/1996 | Amick et al. | 75/246 |

FOREIGN PATENT DOCUMENTS

| | | | |
|---|---|---|---|
| 374726 | 6/1907 | France | 102/506 |

*Primary Examiner*—Harold J. Tudor
*Attorney, Agent, or Firm*—Paul E. Hodges

[57] ABSTRACT

A composite projectile for an ammunition cartridge comprising a core formed for compacted power particulates and having opposite ends. The core is encapsulated within a jacket having an open end. A cap is contained with the jacket adjacent the open end thereof and is physically captured within the jacket in contiguous relationship to that end of the core nearest the open end of the jacket. The cap defines a fixed partition extending across the transverse cross section of the jacket that enhances the concentric positioning about the longitudinal centerline of the jacket of any powder particulates dislodged from that end of the core contiguous to the cap. The core preferably is formed from a cold-compacted mixture of tungsten and lead powders.

5 Claims, 2 Drawing Sheets

PROJECTILE FOR AMMUNITION CARTRIDGE

FIELD OF INVENTION

This invention relates to gun ammunition, and particularly to an improved projectile for incorporation in a round of ammunition.

BACKGROUND OF INVENTION

Modern law enforcement techniques, and certain warfare techniques, at times employ the concept of long range disablement of an offender or enemy. Not uncommonly, this disablement must be effected in the presence of innocent persons, such as bystanders, hostages, etc. In all such instances, accuracy of delivery of the projectile fired from a weapon is most important. One form of long range disablement of this type is carried out by means of snipers which employ long range rifles. It is desired, therefore, that the projectile fired from the rifle be effective at long ranges, such as 1000 yards, for example. Effectiveness in this situation includes accuracy of delivery of the disabling projectile, and elimination or minimization of the disabling effect of the projectile after it has struck its intended first target.

In both law enforcement and warfare, it is not uncommon that only a single shot opportunity may present itself in any given situation. It is therefore imperative that the projectile be delivered with extreme accuracy and with complete effectiveness of disablement. Heretofore, it has been proposed that projectiles be formed of frangible materials that substantially dissipate upon the projectile striking its target, or at least before it can strike some undesired secondary target, such as a hostage. The accuracy with which these projectiles can be delivered to a long range target has been less than desirable. For relatively short range operations, e.g.. 100 yards or less, accuracy of delivery is less critical so that these prior art frangible projectiles have been accepted as representing a cost versus performance compromise.

In the sports shooting and hunting industries, there have been many attempts to combine various metals to produce a projectile which is lead-free but which performs equivalently with lead. To this end, combinations of tungsten or uranium with other and lighter metals have been widely suggested as substitutes for the use of lead in ammunition projectiles. In U.S. Pat. No. 5,399,187, it is disclosed that tungsten powder particulates may be combined with any of several light weight metal powders, other than lead, to provide a "lead-free" projectile, employing powder metallurgy techniques. The powders employed in this patent are to be sintered. Once sintered, the powder composite of this patent becomes difficult to deform, especially without destruction of the sintered bonds. It is suggested in this patent, therefore, that the powder mixture be sintered after having been formed in its "final" shape. This may take the form of filling a jacket with a powder mixture and thereafter sintering the mixture while in the jacket. This and similar sintering procedures tend to adversely affect the structural design and/or integrity of the jacket, and to produce a projectile which may not fully fill the jacket, thereby reducing both the accuracy and repeatability of delivery of the projectile to a target. Moreover, sintering also tends to both deleteriously alter the frangibility of a powder-based projectile and to alter the uniformity of dispersion of the powders within the mix due to the different coefficients of heat expansion of the variety of metal powders employed. This latter factor may adversely affect the accuracy of delivery of the projectile, particularly at long ranges.

The present inventor has found that nonuniformity of distribution of the powder particles within a projectile can cause the center of gravity of the projectile to be altered. This factor further has been found to cause the projectile to "wobble" (yaw) as it travels along its flight path, resulting in inaccuracy of delivery of the projectile. Such wobble in flight is of particular importance in its effect upon accuracy of delivery of the projectile in long range shooting. In the prior art projectiles, this alteration of the projectile's center of gravity is unpredictable from projectile to projectile, hence is an impediment to consistent production of projectiles that exhibit like flight patterns.

U.S. Pat. No. 4,428,295 discloses a spherical projectile for a shot shell in which the projectile is made up of a mixture of tungsten and lead powders, employing compaction of the powder mixture at ambient temperature (below the melting point of lead) and a pressure of at least 20,000 psi. The spherical projectile of this patent is intended to be fired as a member of a group of like projectiles from a shotgun. Consequently, it is initially formed to be sufficiently strong as will prevent its disintegration prior to reaching its target.. This projectile is said to spread out into a disc when heavy weights are dropped on it rather than disintegrating into particles. Frangibility of the projectile is not contemplated in the projectile of this patent, and in fact, appears to be nonexistent. In either long range or close quarter use, this projectile would appear to present a real danger of injuring secondary targets, either by reason of the projectile continuing its flight after striking its initial target and/or through ricochet action. There is no suggestion in this patent that the shot produced can be employed in any ammunition other than a shot shell.

Despite the considerable effort in the prior art to produce projectiles employing powder metallurgy techniques, there is not known to have been discovered heretofore a powder-based projectile which can be delivered accurately and repeatedly at long ranges and/or which exhibits such frangibility as will both permit the projectile to properly penetrate a target and disintegrate in a manner which both enhances the destructive power of the projectile and minimizes the risk of injury to secondary targets. Neither is it known to the present inventor where the prior art has suggested a single means by which the accuracy and penetration capability of frangible projectiles for either "short range" or "long range" use can be enhanced.

SUMMARY OF INVENTION

In accordance with the present invention there is provided an improved projectile for an ammunition cartridge, particularly a rifle cartridge. The projectile of the present invention comprises a core which is powder-based, employing a mixture of tungsten powder and lead powder in one embodiment. In accordance with one aspect of the present invention, the powder mixture is cold-compacted (e.g. at room temperature) to form a cylindrical core. This core is thereafter inserted into a cylindrical jacket (formed of copper, for example) and die-formed into a desired geometry, e.g. having a tapered or ogival leading end. In accordance with the present invention, it is desired that there remain an unfilled portion of the jacket at one end thereof, termed the meplat cavity (front cavity), one function of which is to enhance the stripping away of the jacket upon the projectile striking a target. In a preferred embodiment of the present invention, the core essentially fills all of the interior volume of the jacket except the leading end of the interior cavity of the jacket. The present inventor has found, however, that when die-forming a projectile, having a tapered or ogival leading end, from a cylindrical cold-compacted powder metal core, the integrity of the core is at least partially disrupted (i.e. weakened) or destroyed. Especially, the exposed end of the core adjacent the leading end of the projectile is partially crushed, causing destruction of at least some of the bonds between the metal powder particles of the core at this end of the core. When forming a boattail end on the projectile, similar crushing of the core also takes place. Still further, the pressure experienced by the core during the forming of the tapered ends of the projectile also can result in internal fractures of the core. This activity tends to weaken the bonds between the cold compacted powders. The present inventor has found that in the course of high rotational speeds of the projectile during its flight to the target, powder particles from the exposed end of the core tend to become dislodged. In rifled-barrel weapons, the rotational speed of the projectile can reach many 100's of thousands of rotations per minute (rpm). This rotation subjects the cold-compacted powder to sufficient shear forces as causes further dislodgement of powder particles into the meplat cavity during flight of the projectile. These powder particles in the meplat cavity are unrestrained as to where they become positioned within the meplat cavity. Such dislodgement of the particles, even though relatively small in quantity, has been found to be sufficient to develop nonuniformity of density of the projectile concentrically of and about the longitudinal centerline of the projectile. This nonconcentricity of density alters the center of gravity of the projectile to the extent as will cause an unpredictable amount of wobble (yaw) of the projectile in flight and therefore they constitute a potential source of unpredictable adverse effect upon the accuracy of deliver of the projectile to a target and other adverse effects. In accordance with one aspect of the present invention, the present inventor has discovered that the dislodgement of the powder particles into the meplat can be prevented by inserting into the meplat cavity and in juxtaposition to that end of the core which is adjacent the meplat cavity, a cap, preferably of a ductile metal such as tin and of a disc-like geometry and thereafter die-forming the jacket, the core and the cap to develop a tapered or ogival end of the projectile. The cap preferably extends transversely of the longitudinal centerline of the jacket and forms a type of partition across the diametral dimension of the jacket. The cap is captured and held in position in substantial engagement with the leading end of the core by the collapsed wall of the jacket. In this position the cap prevents any powder particles which are dislodged during die-forming of the end of the core from escaping into the meplat.

The present projectile has been found to exhibit essentially no wobble during its flight to a target, providing for enhanced accuracy of delivery of the projectile. Importantly, the cap does not completely fill the meplat cavity, but rather there remains an empty cavity that opens outwardly of the leading end of the projectile as is desired for enhancing the stripping away of the jacket from the projectile upon its impact with the target.

Importantly, and unexpectedly, the presence of the cap in the meplat cavity of a projectile of the present invention, has been discovered to markedly enhance the penetrating power of the projectile, both at short range and long range use. Further, the present projectile has been found to be markedly quieter in flight presumably by reason of the reduction of yaw during flight.

In accordance with another aspect of the present invention, the inventor has discovered that upon the impact of the present projectile with an initial, relatively dense, target, the relatively soft copper jacket is effectively stripped from the core whereupon the rapidly rotating core, free of the encapsulating jacket, commences disintegrating as the projectile proceeds through the target. So long as the core is within the target, the rapidly rotating and disintegrating powder acts in the nature of a laterally-directed sand blaster, cutting a path through the target which has been found to be materially larger than the initial diameter of the intact projectile, e.g. in excess of 1½ times the diameter of the projectile. However, upon exiting the target, the powder is no longer confined and essentially immediately expands laterally of the path of the projectile for a relatively short distance, quickly losing its velocity and becoming essentially harmless to potential secondary targets. In any event, it has been established by the present inventor that the presence of the cap within the meplat enhances the penetrability of the projectile through a target. This enhancement exists at all ranges, but is particularly evident at long ranges, e.g. 1000 yards.

In has been further found by the present inventor that should the target be sufficiently dense as precludes its penetration by a projectile of the present invention at the existing range, the present projectile imparts its energy to the target and effects the desired disablement, for example, but upon impacting the target, the frangibility of the projectile results in essentially lateral dissipation of the powder without endangering possible secondary targets.

Whereas it is not known with certainty, it is believed that the observed enhancement in the destructive effectiveness of the present projectile upon a target is in part due to the bonds of the cold-compacted powder particles of the core being at least partially disrupted or destroyed during the forming of the jacketed projectile. Upon the stripping away of the jacket when the projectile strikes the target, the less-than-completely-bonded powder particles are no longer constrained and are available to be laterally disbursed by the rotational forces imparted to the projectile upon firing of the projectile from a rifled-barrel weapon. Thus it is believed that the more immediate availability of relatively loose powder particles, either individual particles and/or small clumps of particles, provides a source of laterally directed destructive forces that are instantly available upon the stripping away of the jacket upon its initial impact with the target.

DETAILED DESCRIPTION OF INVENTION

Referring to the Figures, in one embodiment of the present invention there is provided an ammunition projectile indicated generally at 10, comprising a powder-based core 12, a jacket 14 adapted to encapsulate the core therein, and a cap 16 adapted to serve, among other things, as a retainer against the dislodgement of powder particulates from one end 18 of the core when the core is disposed within the jacket.

Figure 1:
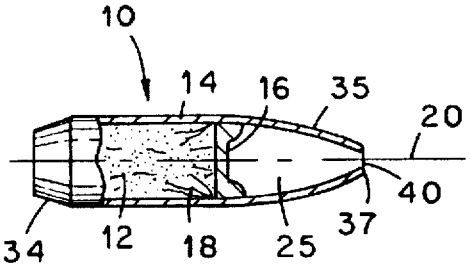
FIG. 1 is a representation, partially cutaway, of one embodiment of a composite projectile core which embodies various of the features of the present invention.
Figure 3A:
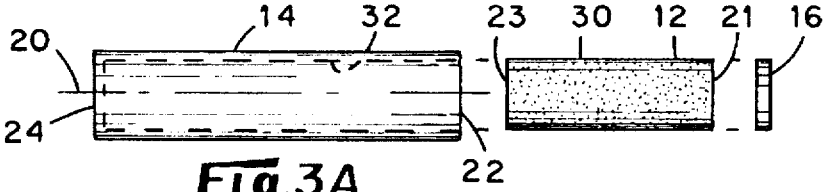
FIGS. 3A—3E are a series of views which depict the steps of assembling a typical composite projectile in accordance with the present invention, including an exploded view that depicts certain of the components of a composite projectile in accordance with the present invention.
Figure 3B:
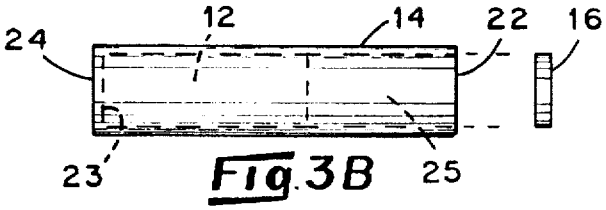
Figure 3C:
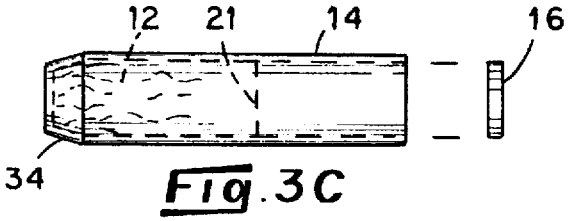
Figure 3D:
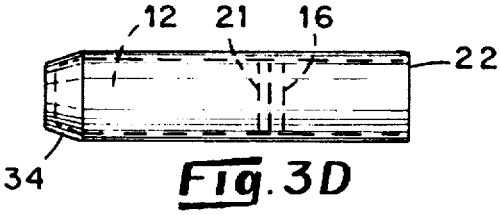
Figure 3E:
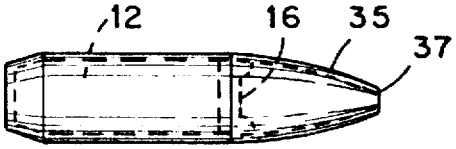

The core of the present projectile desirably exhibits a maximum density for the selected size of the projectile, thereby giving the projectile the capability of delivering a maximum impact energy. In the present invention, the impact energy is a function, not only of the foot-pounds of force with which the projectile strikes a target, but also the ability of the projectile to destroy or disable the target by means of the disintegrating powder of the core. This latter ability, in the present projectile, is a major function of the structure of the projectile and its delivery to the target. For example, when the present projectile is delivered to the target by means of a rifled-barreled weapon, the projectile is rotating very rapidly about its longitudinal centerline 20 (FIG. 1). This provides the projectile with rotational energy which the present inventor has harnessed to enhance the overall effect of the impact energy that the projectile imparts to the target.

The core of the present projectile is powder-based, meaning that the core is made up of a mixture of powders. In the present invention, the preferred powders are tungsten powder and lead powder. Whereas it is preferred that the mixture be tungsten-based, that is, it contains 50% or more, by weight, of tungsten powder, it is acceptable in the manufacture of projectiles intended for special applications that tungsten powder be less than 50% by weight. In the preferred embodiment of the present projectile, the remainder of the powder in the mixture is lead powder. For most applications of use of the present projectile, the percentage of tungsten powder may range from about 40% to about 80%, by weight with the remainder of the mixture being lead. Mixtures of these powders within the stated ranges provide a projectile having a density materially greater than lead, e.g. about 13–14 grams per cubic centimeter ($g/cm^3$).

The preferred tungsten powder exhibits a particle size of about between 10 and 70 mesh. A lead powder of about between 250 and 400 mesh may be employed.

In accordance with one aspect of the present invention, the core 12 is formed by compaction of the mixture of powders at ambient temperature, termed "cold-compaction" herein. The temperature at which compaction is effected may range below or above room temperature, but preferably does not exceed the melting point of lead. Within this range of temperatures, the lead is sufficiently ductile as permits it to be squeezed between the tungsten powder particulates and serve as a binder that holds the tungsten particulates together in a predetermined geometrically shaped core. Recognizing the several requirements imposed upon the powders employed in the present projectile, it will be recognized by one skilled in the art that a powder other than lead, such as tin, may be substituted into the mixture, or a third metal powder may be added to the mixture as desired. Any of these substitutions or additions, however, are subject to lessening the overall density and/or ductility of the core and therefore may be less desirable.

The pressure employed in cold compaction of the powder mixture of the present invention may vary, in part depending upon the given powders used in the mixture. For tungsten/lead powder mixtures, it is preferred that the compaction pressure be greater than about 20,000 psi. Lower compaction pressures fail to sufficiently densify the resulting core product as will permit attaining maximum density of the core. In a preferred embodiment, the core is initially formed as a solid straight cylinder having opposite flat-surfaced ends and having at least 95%, and preferably at least 98%, of the theoretical density of the powder mixture.

Figure 4:
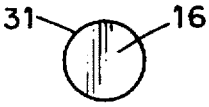
FIG. 4 is a plan top view of one embodiment of a cap employed in the present projectile; and, FIG. 5 is a side view of the cap depicted in FIG. 4.
Figure 5:
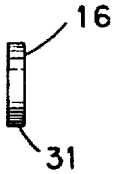
Figure 2:
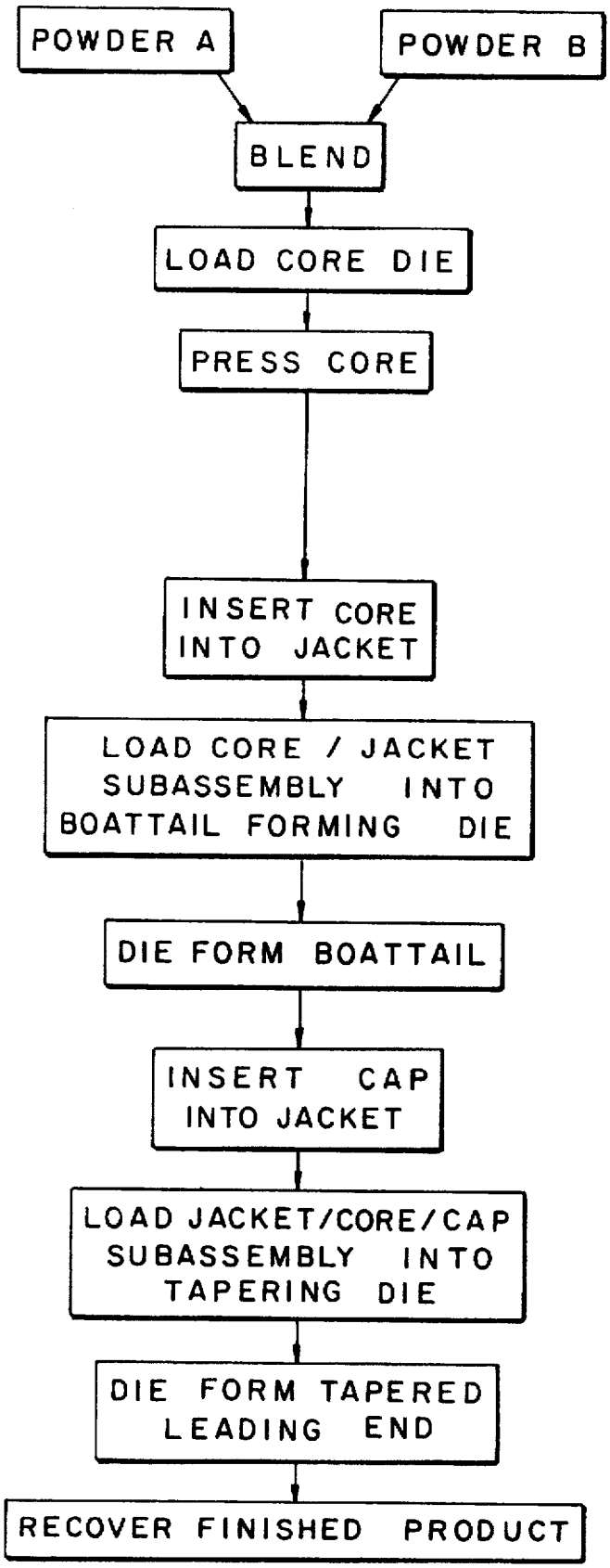
FIG. 2 is a flow diagram depicting one embodiment of the method employed in the manufacture of a composite projectile of the present invention.

The core 12 of the present projectile 10 is preferably encapsulated in a jacket 14, preferably a copper metal jacket. The jacket of the present invention preferably comprises an initially straight hollow metal cylinder having a longitudinal centerline 20, and which is open at least at one end 22 thereof. Preferably the opposite end 24 of the cylinder is closed. A preferred jacket is about ⅕ longer than the length of the core which is to be encapsulated within the jacket, thereby leaving a portion 25 of the end 22 of the jacket free of the core. It is within this empty portion of the interior of the jacket that the cap 16 is inserted. Specifically, a preferred embodiment of the cap of the present invention comprises a disc 16 (see FIGS. 4 and 5)of tin or like ductile metal. The outer circumference of the disc is chosen such that the disc fits snugly within the interior of the jacket but is not so great as to significantly inhibit insertion of the cap into the open end 22 of the jacket. Importantly, initially the disc should lie flat against the flat end 21 of the core. To this end, the circumferential edge 23 of the disc should be free of burrs, distortions, or the like, which might prevent the disc from being readily insertable into the jacket in a position whereby the opposite flat surfaces of the disc lie essentially normal, i.e. at right angles, to the centerline 20 of the jacket. The thickness of disc preferably is uniform across the disc. It will be recognized that various thicknesses of the disc may be employed, so long as the chosen thickness does not vary substantially in uniformity across the diametral dimension of the disc by an amount which will adversely affect the location of the center of gravity of the projectile. In any event, the thickness of the disc must be sufficient to permit the disc to be self-supporting and not subject to distortion in the course of its initial insertion into the jacket. Given the present disclosure, one skilled in the art will recognize that metals other than tin, such as copper or lead may be employed as the material of construction for the cap. In an alternative embodiment, the cap may take the form of a layer of plastic, such an epoxy, that is overlaid on the exposed end 21 of the core.

In the present invention, it is of importance that the cap be positioned concentrically of, and essentially normal to, the longitudinal centerline of the projectile product. In the absence of this alignment of the cap within the jacket, the projectile product is not symmetrical with respect to its weight distribution and tends to wobble during its flight to a target or to vary from the desired flight path to the target, either such event deleteriously affecting the accuracy of delivery of the projectile to a target.

With specific reference to FIGS. 2 and 3A–3E, one embodiment of the method for the manufacture of a projectile of the present invention includes the steps of selecting a first powder, tungsten powder, for example; selecting a second powder, lead powder, for example; blending these powders to form a mixture thereof; measuring a quantity of the blended powders into a core die; pressing the powders within the core die into a solid straight cylindrical core; selecting a jacket; inserting the core into the jacket; loading the core/jacket subassembly into flat base boattail forming die; die forming the boattail; inserting a cap into the jacket; loading the jacket/core/cap subassembly into a tapering die; die forming a tapered leading end on the projectile; and recovering the finished projectile.

As noted, in one embodiment, the blended powder mixture is measured into a core die and pressed within the core die into a solid straight cylindrical core. The core is designed to be inserted into the jacket. In the present invention, it is desired that there be essentially no open space between the outer wall 30 of the core and the inner wall 32 of the jacket. To this end, the core is formed to very close outer diametral tolerances along its entire length, and only jackets having like close inner wall diametral tolerances are employed. Preferably, the outer diametral dimension of the core is only very slightly less than the inner diametral dimension of the jacket, such that the core will readily enter the open end of the jacket without material force being applied to the core. Also as noted, the length dimension of the core is about 4/5 the length dimension of the jacket so that there is open space remaining at the open end 22 of the jacket after the core has been fully inserted into the jacket. This open space eventually defines the meplat cavity 25.

As depicted in FIGS. 3A–3E, in the course of manufacture of the projectile of the present invention, a core 12 is inserted into a jacket 14 with one end 23 of the core being disposed adjacent the closed end 24 of the jacket, thereby leaving the opposite open end 22 of the jacket free of core. This open area 25 is known as the meplat cavity (front cavity). The end 24 of the jacket and the end 23 of the core are die-formed to develop a boattail end 34 of the projectile. Thereafter, as depicted in the Figures, a disc-like cap 16 is also placed within the interior of the jacket contiguous to the end 21 of the core. Thereupon, the opposite end 22 of the jacket and core, along with the enclosed cap, are die-formed to provide an inwardly tapered section 35 of the projectile. This latter die-forming operation serves also to squeeze the cap radially inwardly of the jacket, causing the cap to be deformed (see FIG. 3E) and securely captured within the jacket to form a fixed partition across the diametral dimension of the jacket and contiguous to the end 21 of the core and thereby anchor the cap within the jacket and contiguous to the end 21 of the core. Most commonly, the taper 35 is a curved taper which has a radius that is a function of the outer diameter of the jacket. For example, the taper may be an "eight ogive" taper, meaning that the taper has a radius of curvature that is eight times the outer diameter of the jacket. This taper generally is chosen as a function of the intended performance of the projectile. For example, a longer taper may be chosen for enhancing the target penetration ability of the projectile. In one embodiment, in a 0.308" diameter jacket having an eight ogive taper, the taper extends over about 1/3 of the overall length of the projectile.

Notably, the initially open end 22 of the jacket is not fully closed when the die forming of the jacket, core and cap is completed, but rather there remains at the distal end 37 of the jacket an opening 40 that extends inwardly of the projectile. This opening is provided to enhance the breaking away of at least the jacket element of the projectile upon impact with a target as is well known in the art.

In the course of forming the boattail end of the jacketed case, the pressure employed forces the square end of the jacket and the square end of the core into the boattail forming die. This action results in disruption and/or destruction of the bonds between those powder particles which are in the immediate vicinity of the boattail. Further, the pressure causes line fractures 40 to develop within the core. In like manner, after the boattail has been formed, when the opposite end of the jacketed core is pressed into the tapering die, the bonds between the powder particles in the immediate vicinity of the end 21 of the core are disrupted and/or destroyed. Prior to the present invention, this action resulted in free and/or loosened powder particles in the meplat. Following firing of the weapon, the rapid rotation of the projectile while in free flight to the target generates large centrifugal forces. In the absence of a cap as disclosed herein, the loosened powder particles were broken free so that these and other free powder particles tended to accumulate unevenly about the inner circumference of the meplat, causing the projectiles to be circumferentially unsymmetrical in density. These accumulations were unpredictable in size and location within the meplat. This prevented the manufacture of consistently performing projectiles. In the present invention this undesirable prior condition is overcome through the inclusion of the cap within the meplat cavity in contiguous relationship to the end 21 of the core. In this position, the cap restrains the dislodgement of powder particles from the end 21 of the core, both during the tapering operation and during the free flight of the fast rotating projectile. The presence of the cap and its containment function permits the present inventor to repeatedly produce projectiles which are uniformly dense about and concentric with the longitudinal centerline 20 of the projectile. The result is a projectile having predictable and repeatable performance characteristics.

In firing tests employing five rounds of a 250 grain projectile, which included a cap in accordance with the present invention, fired from a rifle at a target 1000 yards distant, the pattern obtained typically exhibited a vertical spread of about 1/3 minute of angle (MOA) and a horizontal spread of about 2/3 MOA. The same firing tests employing a projectile which did riot include a cap typically exhibited a pattern having a vertical spread of about 2/3 MOA and a horizontal spread of about 1 MOA. This same projectile (including a cap), when fired into a 1/4 "thick mild steel target, fully penetrated the target. Like projectiles which did not include a cap, failed to penetrate the same target, but left a substantial crater in the surface of the target. These latter projectiles fully disintegrated upon striking the target. Unexpectedly, those projectiles with caps which penetrated the target, created an opening through the target having a diameter in excess of 1½ the original diameter of the projectile and exhibited signs of erosion of metal from the side wall of the opening.

Whereas the present invention has been described with respect to specific embodiments, it is intended that the invention be limited only as set forth in the attached claims.

What is claimed:

1. A projectile having a leading end, a trailing end and a longitudinal centerline, for an ammunition cartridge for a gun, the combination comprising a one-piece jacket including an open leading end and a closed trailing end and a central cylindrical body portion disposed between said leading and trailing ends, a core having a leading end portion, a trailing end portion and a cylindrical body portion disposed between said leading and trailing ends of said core, said core being disposed fully within said jacket with its trailing end in juxtaposition to said trailing end of said jacket, with its cylindrical body portion being disposed within said body portion of said jacket, and with its leading end portion disposed torward said open leading end of said jacket, said core being formed from a mixture of compacted metal powders and in the body portion thereof having a density greater than the density of lead and at least about 95% of the maximum theoretical density of said mixture of metal powders, said leading end portion of said core including powders bonded to a lesser extent than powders of said body portion of said core, said powders of said leading end portion of said core being not bonded sufficiently to preclude their dislodgement from said leading end portion of said core in the course of propulsion of the projectile from a gun barrel and its flight to a target, and a solid cap disposed within the jacket adjacent the open end thereof in engagement with said leading end of said core and oriented substantially concentrically of the centerline of the projectile, said leading end of said jacket and said cap being conjointly tapered inwardly proximate said open leading end of said jacket to define an ogive and an empty front cavity at the leading end of the projectile, whereby said cap resides in said ogive and prevents the escape of said powders in said leading end of said core into said front cavity prior to the impact of the projectile with a target.

2. The projectile of claim 1 wherein said cap is formed of metallic tin.

3. The projectile of claim 1 wherein said mixture of powders comprises between about 40 and 80 percent tungsten and the remainder to comprise 100% is lead.

4. The projectile of claim 3 wherein said mixture of powders comprises about 60% tungsten and about 40% lead.

5. The projectile of claim 1 wherein the jacket comprises copper.

* * * * *